US006967625B1

(12) United States Patent
Honda

(10) Patent No.: US 6,967,625 B1
(45) Date of Patent: Nov. 22, 2005

(54) E-PLANE OMNI-DIRECTIONAL ANTENNA

(75) Inventor: Royden M. Honda, Spokane, WA (US)

(73) Assignee: Vivato, Inc., San Francisco, CA (US)

( * ) Notice: Subject to any disclaimer, the term of this patent is extended or adjusted under 35 U.S.C. 154(b) by 95 days.

(21) Appl. No.: 10/335,382

(22) Filed: Dec. 31, 2002

(51) Int. Cl.[7] ..... H01Q 13/10
(52) U.S. Cl. ..... 343/771; 343/770
(58) Field of Search ..... 343/770, 771, 343/772

(56) References Cited

U.S. PATENT DOCUMENTS 5,619,216 A * 4/1997 Park ..... 343/771
5,650,793 A * 7/1997 Park ..... 343/771
6,127,985 A * 10/2000 Guler ..... 343/771
6,166,701 A * 12/2000 Park et al. ..... 343/771
6,252,544 B1 6/2001 Hoffberg
6,344,829 B1 * 2/2002 Lee ..... 343/753
6,429,812 B1 8/2002 Hoffberg
6,476,772 B1 * 11/2002 Smith et al. ..... 343/771

OTHER PUBLICATIONS

TIL–TEK Antennas, "TA–2300H Omnidirectional 2300–2500 MHz," Form 2002–2300H, Nov. 1, 2001, 1 page.

* cited by examiner

*Primary Examiner*—Tho Phan
(74) *Attorney, Agent, or Firm*—Lee & Hayes, PLLC

(57) ABSTRACT

In an implementation, an E-plane omni-directional antenna element includes five coplanar waveguide dipoles that are each configured to generate an e-field transmission. A center section of the antenna element couples the five coplanar waveguide dipoles to a radio frequency transmission signal such that the e-field transmission from each of the five coplanar waveguide dipoles are combined to form an E-plane omni-directional transmission pattern.

38 Claims, 7 Drawing Sheets

E-PLANE OMNI-DIRECTIONAL ANTENNA

TECHNICAL FIELD

This invention relates to antenna technology and, in particular, to an E-plane omni-directional antenna.

BACKGROUND

Computing devices and other similar devices implemented to send and/or receive data can be interconnected in a wired network or a wireless network to allow the data to be communicated between the devices. Wired networks, such as wide area networks (WANs) and local area networks (LANs) for example, tend to have a high bandwidth and can therefore be configured to communicate digital data at high data rates. One obvious drawback to wired networks is that the range of movement of a device is constrained since the device needs to be physically connected to the network for data exchange. For example, a user of a portable computing device will need to remain near to a wired network junction to stay connected to the wired network.

An alternative to wired networks is a wireless network that is configured to support similar data communications in a more accommodating manner. For example, the user of the portable computing device can move around within a region that is supported by the wireless network without having to be physically connected to the network. A limitation of wireless networks, however, is their relatively low bandwidth which results in a much slower exchange of data than a wired network. Wireless networks will become more popular as data exchange rates arc improved and as a coverage area supported by a wireless network is expanded.

Monopole and dipole antennas can be implemented in broadcast and communication applications. For a vertically polarized antenna, an E-plane contains an electric field vector and coincides with a vertical plane relative to the antenna. An H-plane contains a magnetic field vector and coincides with a horizontal plane relative to the antenna. The antenna radiates an omni-directional transmission pattern in the H-plane. That is, an electromagnetic field is radiated in an omni-direction pattern from the antenna in a plane that is normal (e.g., S perpendicular) to an axis of the antenna.

An antenna described as "omni-directional" implies an antenna that radiates equally in all directions. However, although some antennas are identified by their manufacturers as "omni-directional", an actual omni-directional antenna has not been devised. For a horizontally polarized antenna, the transmission pattern in the E-plane is not truly omni-directional. That is, the electric field radiated in a plane that is perpendicular to the axis of the antenna is not a complete omni-directional transmission pattern.

A conventional horizontally polarized antenna design includes dipoles arrayed in a quadrature configuration in the same plane and excited in a phase relationship that generates an overall far-field transmission pattern that is a sum of the four dipole transmission patterns. However, the E-plane transmission pattern for a single half-wavelength dipole has a half-power beamwidth of approximately seventy-eight degrees (78°). As a result, the far-field transmission pattern has an approximate three (3) dB loss (e.g., a dip, or a null which is a region of low intensity) every forty-five degrees plus the product of ninety and n-degrees (e.g., 45°+90n°), where n=0, 1, 2, 3 in the omni plane.

Accordingly, there is a need for a high gain antenna that provides an E-plane omni-directional transmission pattern without nulls or losses that preclude complete coverage over a desired transmission region.

SUMMARY

An E-plane omni-directional antenna is described herein.

In an implementation, an E-plane omni-directional antenna element includes five coplanar waveguide dipoles that are each configured to generate an e-field transmission. A center section of the antenna element couples the five coplanar waveguide dipoles to a radio frequency transmission signal such that the e-field transmission from each of the five coplanar waveguide dipoles are combined to form an E-plane omni-directional transmission pattern.

In another implementation, an E-plane omni-directional antenna can be implemented with one or more of the E-plane omni-directional antenna elements.

BRIEF DESCRIPTION OF THE DRAWINGS

The same numbers are used throughout the drawings to reference like features and components.

DETAILED DESCRIPTION

A wireless communication system may include at least one wireless routing device that is configured to communicate over a wireless communication link via an antenna assembly with at least one device implemented for communication within the wireless system. The wireless communication system can be implemented to communicate with multiple devices, such as portable computers, computing devices, and any other type of electronic and communication device that can be configured for wireless communication. Further, the multiple devices can be configured to communicate with one another within the wireless communication system. The wireless communication system can be implemented as a wireless local area network (WLAN), a wireless wide area network (WAN), a wireless metropolitan area network (MAN), or other similar wireless network configurations.

The following discussion is directed to an antenna assembly that may be Implemented within a wireless communication system. While the antenna assembly may be applicable or adaptable for use in other communication systems, the antenna assembly is described in the context of the following exemplary environment. An E-plane omni-directional antenna is described herein that provides an E-plane omni-directional transmission pattern (e.g., a far-field pattern) without nulls or losses that would preclude complete coverage over a desired transmission region.

Figure 1:
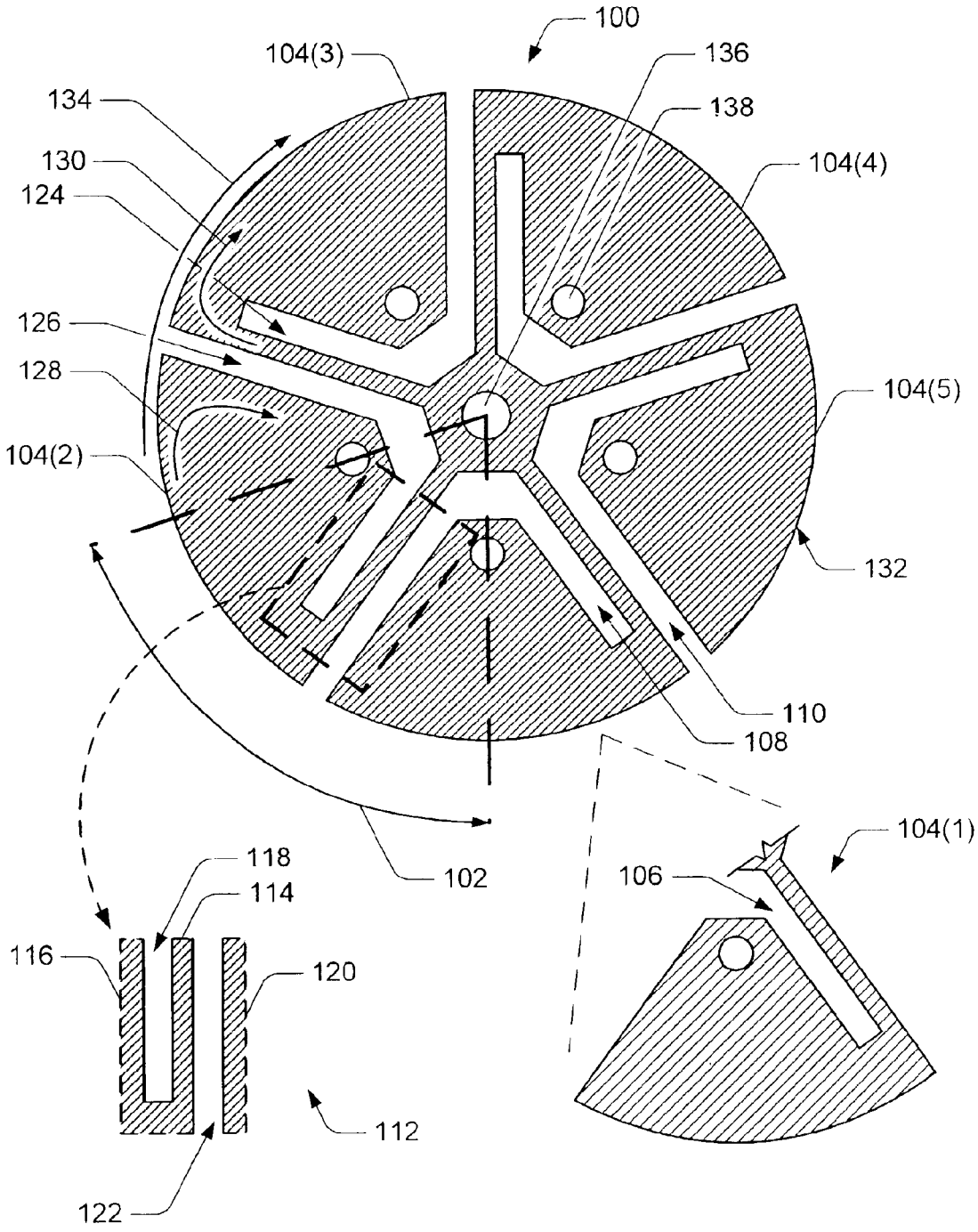
FIG. 1 illustrates an exemplary E-plane omni-directional antenna element.

FIG. 1 illustrates an exemplary E-plane omni-directional antenna element 100 that provides an E-plane omni-directional transmission pattern. The antenna element 100 has five integrated balun coplanar wave guide dipoles, such as section 102 of the antenna assembly 100. The coplanar waveguide dipole 102 is formed with adjacent slotted coplanar sectors 104 of the antenna assembly 100. For example, coplanar waveguide dipole 102 is formed by slotted coplanar sector 104(1) (also shown as an individual section of antenna element 100) positioned adjacent slotted coplanar sector 104(2).

Each slotted coplanar sector 104 is a half of two coplanar waveguide dipoles of antenna element 100 (e.g., each slotted coplanar sector 104 is positioned adjacent two other slotted coplanar sectors). For example, slotted coplanar sector 104(1) is a first half of the coplanar waveguide dipole 102 and slotted coplanar sector 104(2) is a second half of the coplanar waveguide dipole 102. Similarly, slotted coplanar sector 104(1) forms another coplanar waveguide dipole with slotted coplanar sector 104(5).

Each slotted coplanar sector 104 includes, or is otherwise formed with, a slot 106 that is a shorted coplanar waveguide channel, such as shorted coplanar waveguide channel 108 formed in the slotted coplanar sector 104(1). The slot 106 in the individual slotted coplanar sector 104(1) is the shorted coplanar waveguide channel 108 when the slotted coplanar sectors 104 are positioned to form the antenna element 100. Additionally, each slotted coplanar sector 104 forms a coplanar waveguide channel with an adjacent slotted coplanar sector 104. For example, slotted coplanar sector 104(1) forms a coplanar waveguide channel 110 between the adjacent slotted coplanar sector 104(5) when the slotted coplanar sectors 104(1) and 104(5) are positioned, or otherwise formed, adjacent each other in the antenna element 100.

The coplanar waveguide dipole 102 includes a coplanar waveguide 112 (also separately illustrated). A conductor 114 of the coplanar waveguide 112 is separated from a first ground plane 116 by a shorted coplanar waveguide channel 118. The conductor 114 is also separated from a second ground plane 120 by a coplanar waveguide channel 122. The conductor 114, ground plane 116, and shorted coplanar waveguide channel 118 are formed as part of slotted coplanar sector 104(2). The ground plane 120 is formed as part of slotted coplanar sector 104(1), and the coplanar waveguide channel 122 is formed between the adjacent slotted coplanar sectors 104(1) and 104(2).

The coplanar waveguide dipole 102 includes a balun that is formed by the shorted coplanar waveguide channel 118 of the slotted coplanar sector 104(2) and the coplanar waveguide channel 122 formed between the adjacent slotted coplanar sectors 104(1) and 104(2). A balun balances radio frequency (RF) currents between adjacent slotted coplanar sectors to provide an optimum distribution of the RF currents between the two dipole halves. For example, a balun is formed by a shorted coplanar waveguide channel 124 and a coplanar waveguide channel 126 to balance opposing currents 128 and 130 that are generated on either side of the coplanar waveguide channel 126.

The outer edge 132 of each slotted coplanar sector 104 (e.g., also the outer edge of each coplanar waveguide dipole 102) is a curve that forms an arc section of a circle and, when combined with each of the five slotted coplanar sector outer edges and/or coplanar waveguide dipole outer edges, forms the outer edge 132 of the antenna element 100. The currents (e.g., currents 128 and 130) flow along the outer edge 132 of the antenna element 100 forming a uniform current ring 134 that is interrupted by the coplanar waveguide channels (e.g., coplanar waveguide channels 110, 122, and 126, for example) which creates uniform e-fields that radiate outward from antenna element 100 to form an omni-directional transmission pattern in the far-field.

The antenna element 100 includes, or is otherwise formed with, a center conductor connection 136. Additionally, each slotted coplanar sector 104 includes, or is otherwise formed with, an outer conductor connection 138. The center conductor connection 136 can be coupled to a center conductor of a coaxial signal feed line and each outer conductor connection 138 can be coupled to an outer conductor of the coaxial signal feed line.

An impedance of antenna element 100 can be matched to the impedance of the coaxial signal feed line with the coplanar waveguide channels (e.g., coplanar waveguide channels 110, 122, and 126, for example) that are formed between each of the dipole halves (e.g., two of the slotted coplanar sectors 104). An antenna assembly formed with multiple antenna elements 100 that are configured to match the impedance of a signal feed line can be implemented with a matching network between the antenna assembly and the signal feed line.

The antenna element 100 can be etched on a copper clad laminate, stamped out of sheet metal, or manufactured with similar methods from any number of different types of materials and/or composites conducive to electromagnetic transmissions. Although antenna element 100 is shown circular, the antenna element may also be implemented as an oval, elliptical, or as a pentagonal antenna element.

Figure 2:
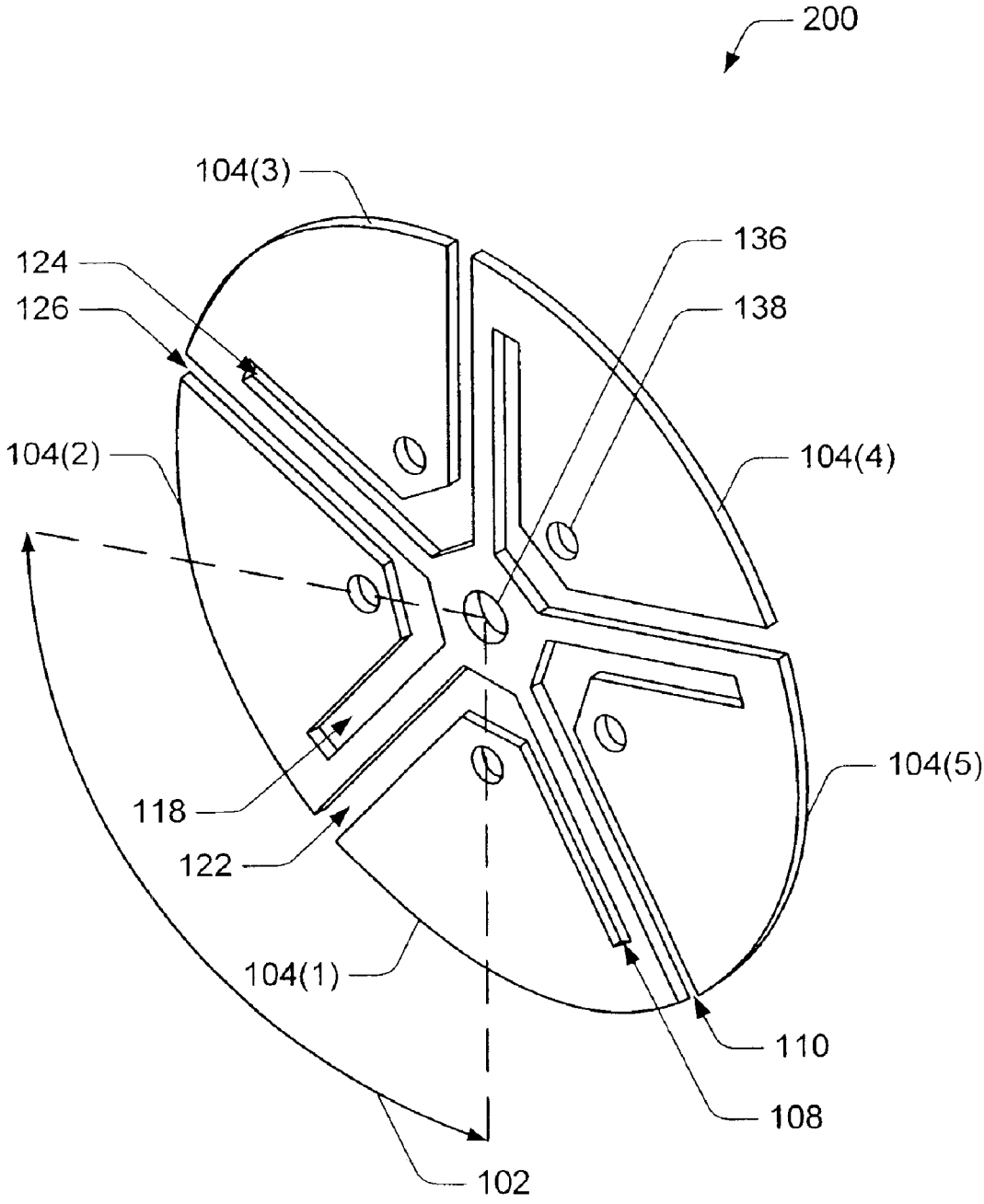
FIG. 2 further illustrates the exemplary E-plane omni-directional antenna element shown in FIG. 1.

FIG. 2 further illustrates a perspective view 200 of the E-plane omni-directional antenna element 100 shown in FIG. 1. The same identifiers that arc shown in FIG. 1 are used to identify the features and components of the antenna element 100 as shown in FIG. 2.

Figure 3:
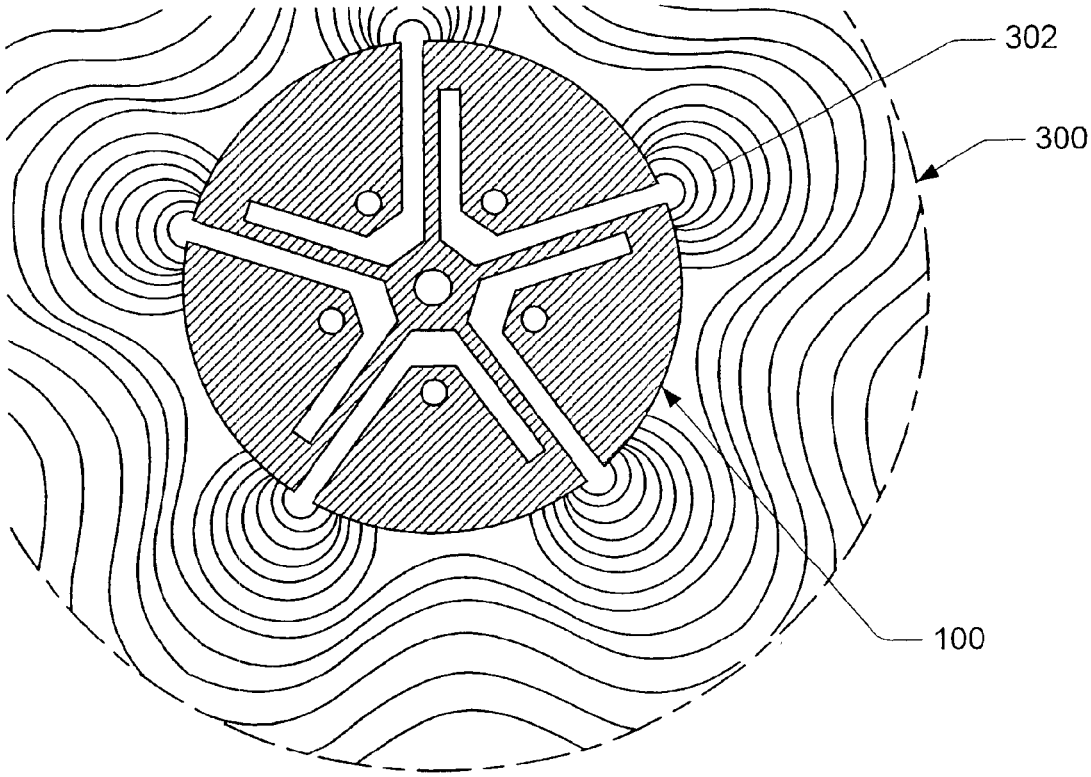
FIG. 3 illustrates a transmission pattern generated with the exemplary E-plane omni-directional antenna element shown in FIG. 1.

FIG. 3 illustrates a transmission pattern 300 generated with the exemplary E-plane omni-directional antenna element 100 shown in FIG. 1. As described above with reference to FIG. 1, currents (e.g., currents 128 and 130) flow along the outer edge of the antenna element 100 forming a uniform current ring that is interrupted by the coplanar waveguide channels (e.g., coplanar waveguide channels 110, 122, and 126). This creates uniform e-fields 302 that radiate outward from antenna element 100 to form the E-plane omni-directional transmission pattern 300 in the far-field.

Figure 4:
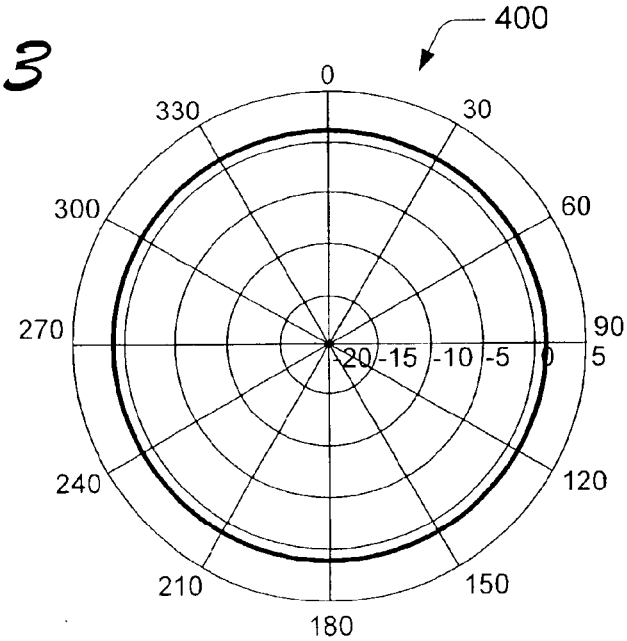
FIG. 4 illustrates a polar logarithmic plot on which the transmission pattern generated with the E-plane omni-directional antenna element shown in FIG. 3 is charted.

FIG. 4 illustrates a polar logarithmic plot 400 that charts the transmission pattern 300 shown in FIG. 3. The plot illustrates that throughout three-hundred and sixty degrees (360°), the transmission pattern is omni-directional in the E-plane without any nulls or losses.

Figure 5:
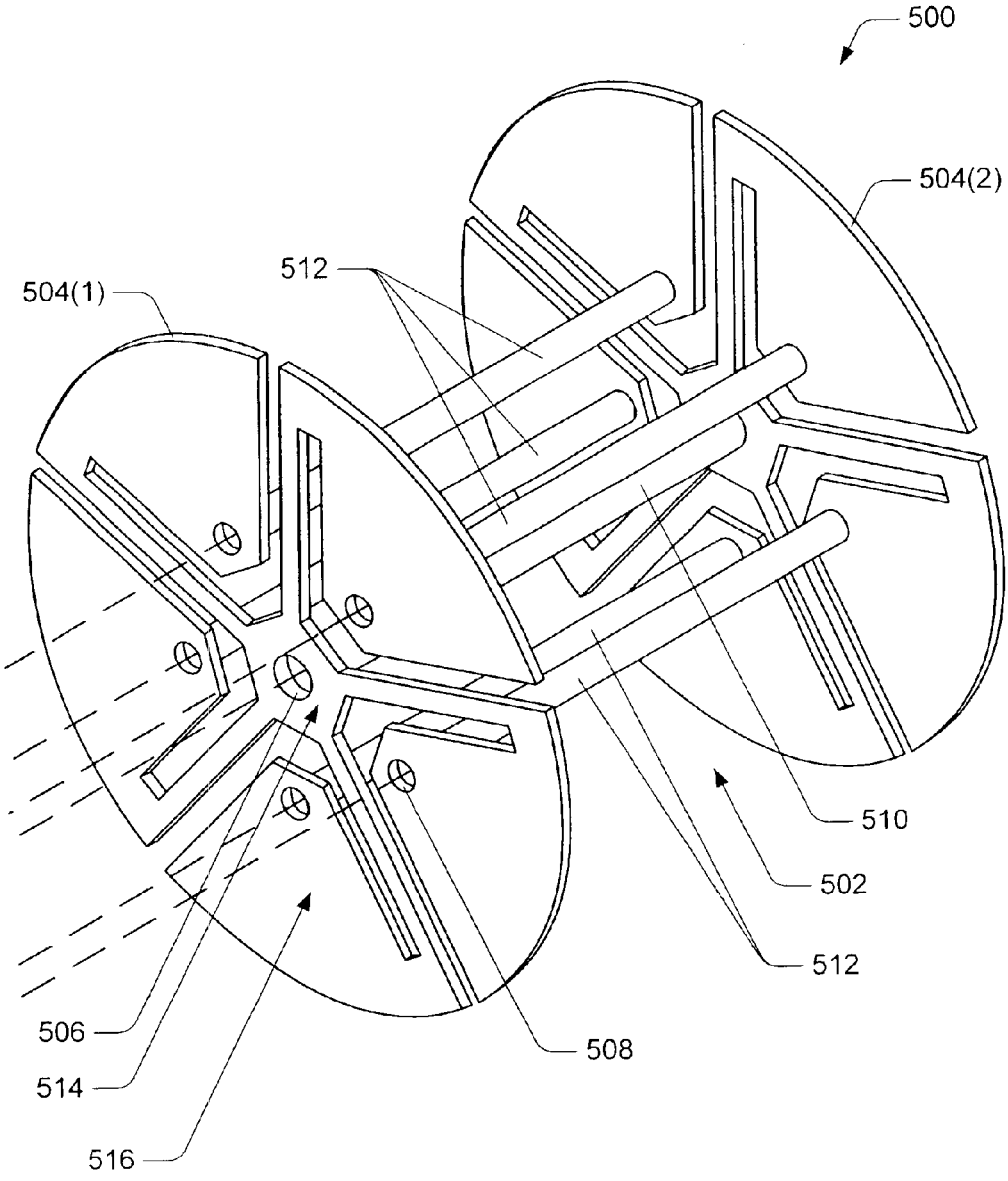
FIG. 5 illustrates an exemplary E-plane omni-directional antenna assembly with an exemplary transmission signal connection system.

FIG. 5 illustrates an exemplary antenna assembly 500 with an exemplary transmission signal connection system 502 that couples together multiple E-plane omni-directional antenna elements 504(1) and 504(2) which can each be implemented as an exemplary E-plane omni-directional antenna element 100 as shown in FIGS. 1 and 2. Each of the antenna elements 504 have a center conductor connection 506 and multiple outer conductor connections 508.

The transmission signal connection system 502 includes a center conductive rod 510 that is coupled to an antenna element 504 at the center conductor connection 506. The transmission signal connection system also includes multiple outer conductive rods 512 that are coupled to an antenna element 504 at the outer conductor connections 508. In this example, five outer conductive rods 512 are implemented to couple the antenna elements 504 to form the antenna assembly 500. The center conductive rod 510 can be coupled to a center conductor of a coaxial signal feed line and each outer conductive rod 512 can be coupled to an outer conductor of the coaxial signal feed line.

The center conductor of a coaxial signal feed line is coupled to a center 514 of an antenna element 504 via the center conductive rod 510. The outer conductor (e.g., the shield) of the coaxial signal feed line is coupled to the slotted coplanar sectors 516 of the antenna element 504 via the outer conductive rods 512. Each slotted coplanar sector 516 is coupled to the outer conductor of the coaxial signal feed line via one outer conductive rod 512. Each additional antenna element 504 added to the antenna assembly 500 is coupled to the structure via an additional center conductive rod and multiple additional outer conductive rods.

Figure 6:
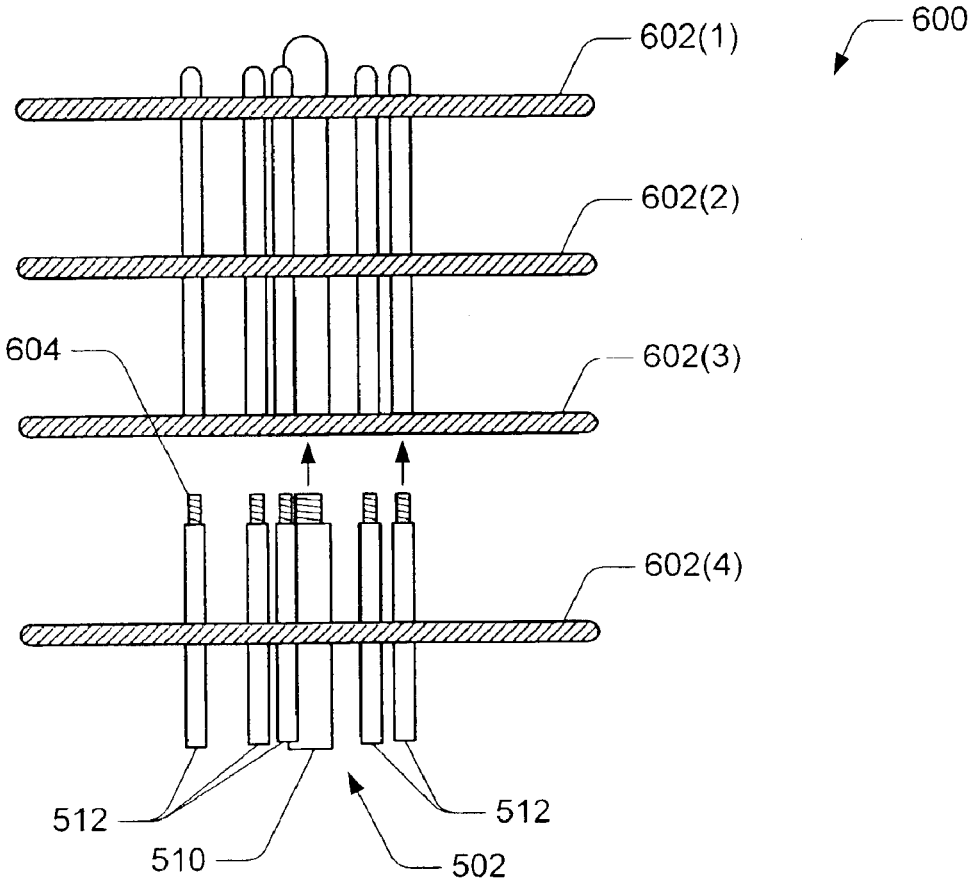
FIG. 6 illustrates an exemplary E-plane omni-directional antenna assembly of multiple antenna elements each coupled together with a transmission signal g connection system as shown in FIG. 5.

FIG. 6 illustrates an exemplary antenna assembly 600 that includes multiple E-plane omni-directional antenna elements 602 each coupled with a transmission signal connection system 502 as shown in FIG. 5. The antenna elements 602 can each be implemented as an exemplary E-plane omni-directional antenna element 100 as shown in FIGS. 1 and 2. The multiple antenna elements 602 can be stacked to form a vertical array of the antenna elements. Each center conductive rod 510 and each of the outer conductive rods 512 can be implemented with male to female stand-offs 604, for example, that are screwed together to mechanically couple each antenna element 602 to the next. Alternatively, the outer and center conductive rods can be implemented with any type of mechanism that couples the antenna elements 602 together to form antenna assembly 600.

The antenna assembly 600, with the multiple antenna elements 602, provides a high-gain horizontally polarized omni-directional transmission pattern. Although only four antenna elements 602 are shown communicatively coupled in FIG. 6, any number of antenna elements 602 can be coupled together, either horizontally or vertically, with conductive rods 510 and 512 to increase the gain of antenna assembly 600.

Figure 7:
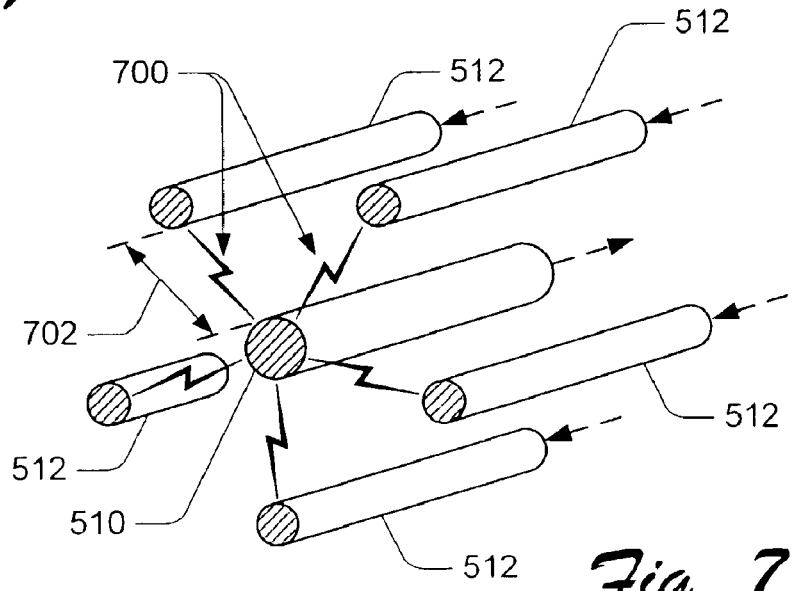
FIG. 7 further illustrates the exemplary transmission signal connection system shown in FIGS. 5 and 6.

FIG. 7 further illustrates the exemplary transmission signal connection system 502 shown in FIGS. 5 and 6. The connection system 502 can be implemented to replace a coaxial cable that contains two conductors which share the same axis and are concentric. A coaxial cable has one center conductor and an outside conductor formed around the center conductor and separated by an insulating layer. Similar to a coaxial cable, the connection system 502 has the center conductive rod 510 separated from the outer conductive rods 512 which are grounded returns that provide an outer shield for the center conductive rod 510. The outer conductive rods 512 serve to concentrate e-fields 700 between the center conductor (e.g., center conductive rod 510) and an outer conductor (e.g., an outer conductive rod 512) to form a transverse electromagnetic (TEM) propagated wave within a space 702 between the center conductive rod 510 and an outer conductive rod 512.

Figure 8:
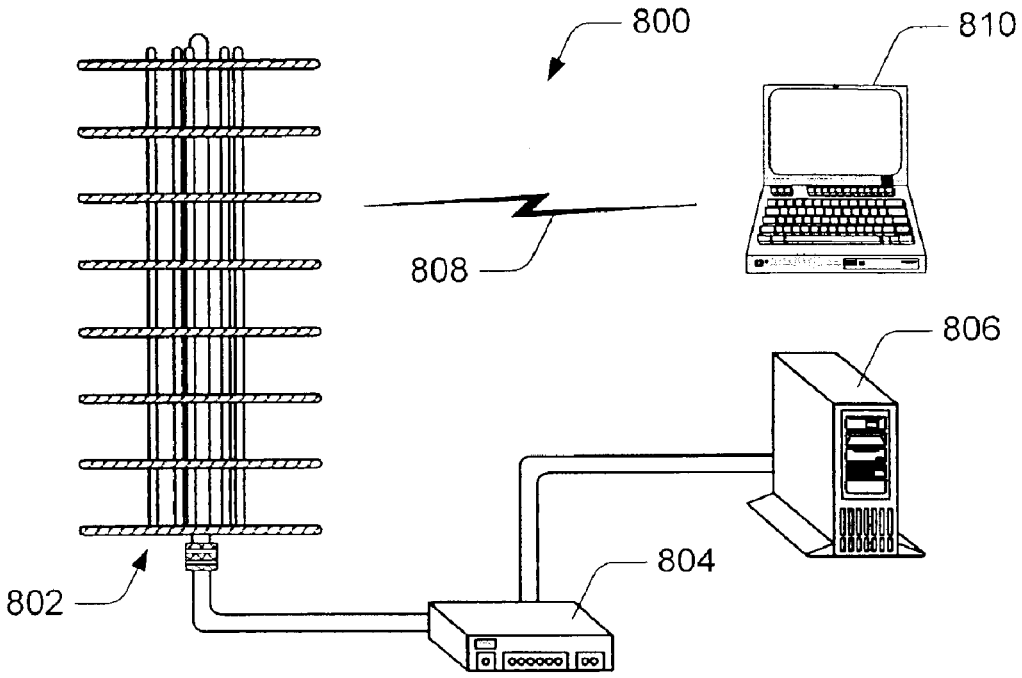
FIG. 8 illustrates an exemplary antenna system.

FIG. 8 illustrates an exemplary antenna system 800 that can be implemented in a wireless communications system. Antenna system 800 includes a series fed (resonant array) antenna assembly 802 that is coupled at one end to a network switch 804, such as via a wired communication cable to a local area network (LAN) switch. The network switch is communicatively coupled to a server computing device 806 that communicates data information to antenna assembly 802 for wireless transmission. The antenna assembly 802 can be implemented as antenna assembly 600 (FIG. 6) that includes multiple E-plane omni-directional antenna elements 100 (FIG. 1) each coupled with the transmission signal connection system 502 as shown in FIGS. 5-7.

The antenna assembly 802 is implemented to wirelessly communicate the data information received via the network connection 804 to any number of electronic and computing devices that are client devices configured to recognize and receive transmission signals 808 transmitted from the antenna assembly 802. Such electronic and computing devices can include desktop and portable computing devices that are configured with a wireless communication card, such as portable computing device 810, and any other type of electronic device to include a personal digital assistant (PDA), cellular phone, and similar mobile communication devices, or devices that can be configured for wireless communication connectivity. Some of the electronic and computing devices may also be connected together via a wired network and/or communication link.

Figure 9:
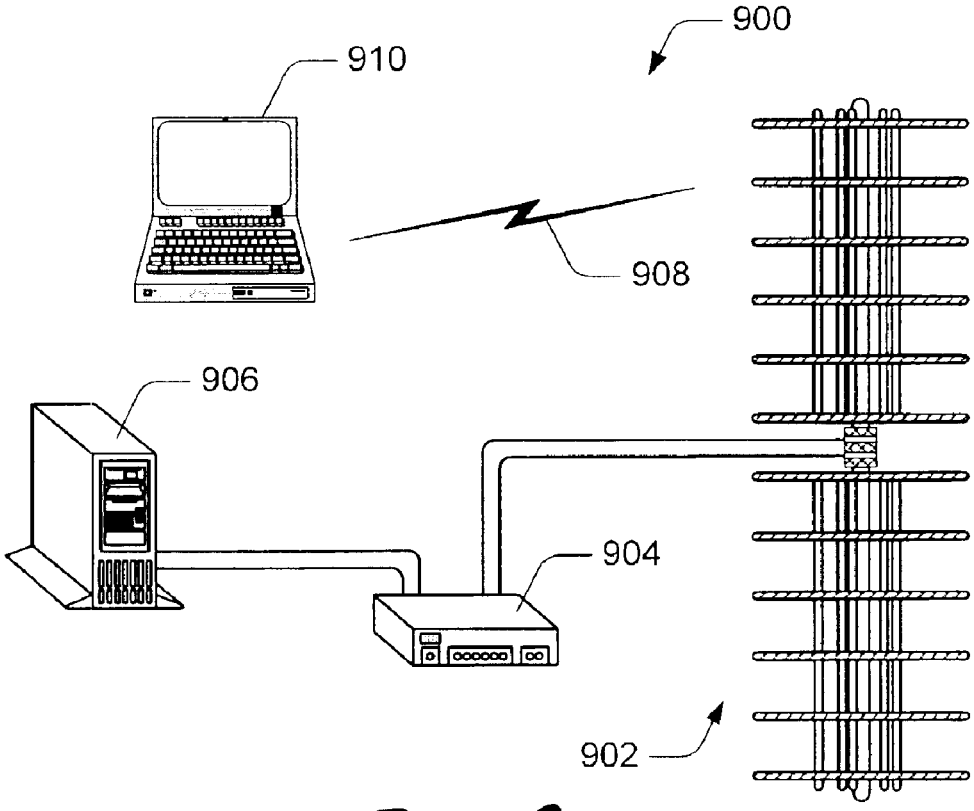
FIG. 9 illustrates an exemplary antenna system.

FIG. 9 illustrates an exemplary antenna system 900 that can be implemented in a wireless communications system. Antenna system 900 includes a center fed antenna assembly 902 that is coupled at a center connection point to a network switch 904, such as via a wired communication cable to a local area network (LAN) switch. The network switch is communicatively coupled to a server computing device 906 that communicates data information to antenna assembly 902 for wireless transmission. The antenna assembly 902 can be implemented as antenna assembly 600 (FIG. 6) that includes multiple E-plane omni-directional antenna elements 100 (FIG. 1) each coupled with the transmission signal connection system 502 as shown in FIGS. 5-7.

The antenna assembly 902 is implemented to wirelessly communicate the data information received via the network connection 904 to any number of electronic and computing devices that arc client devices configured to recognize and receive transmission signals 908 transmitted from the antenna assembly 902. Such electronic and computing devices can include desktop and portable computing devices that are configured with a wireless communication card, such as portable computing device 910, and any other type of electronic device to include a personal digital assistant (PDA), cellular phone, and similar mobile communication devices, or devices that can be configured for wireless communication connectivity. Some of the electronic and computing devices may also be connected together via a wired network and/or communication link.

Figure 10:
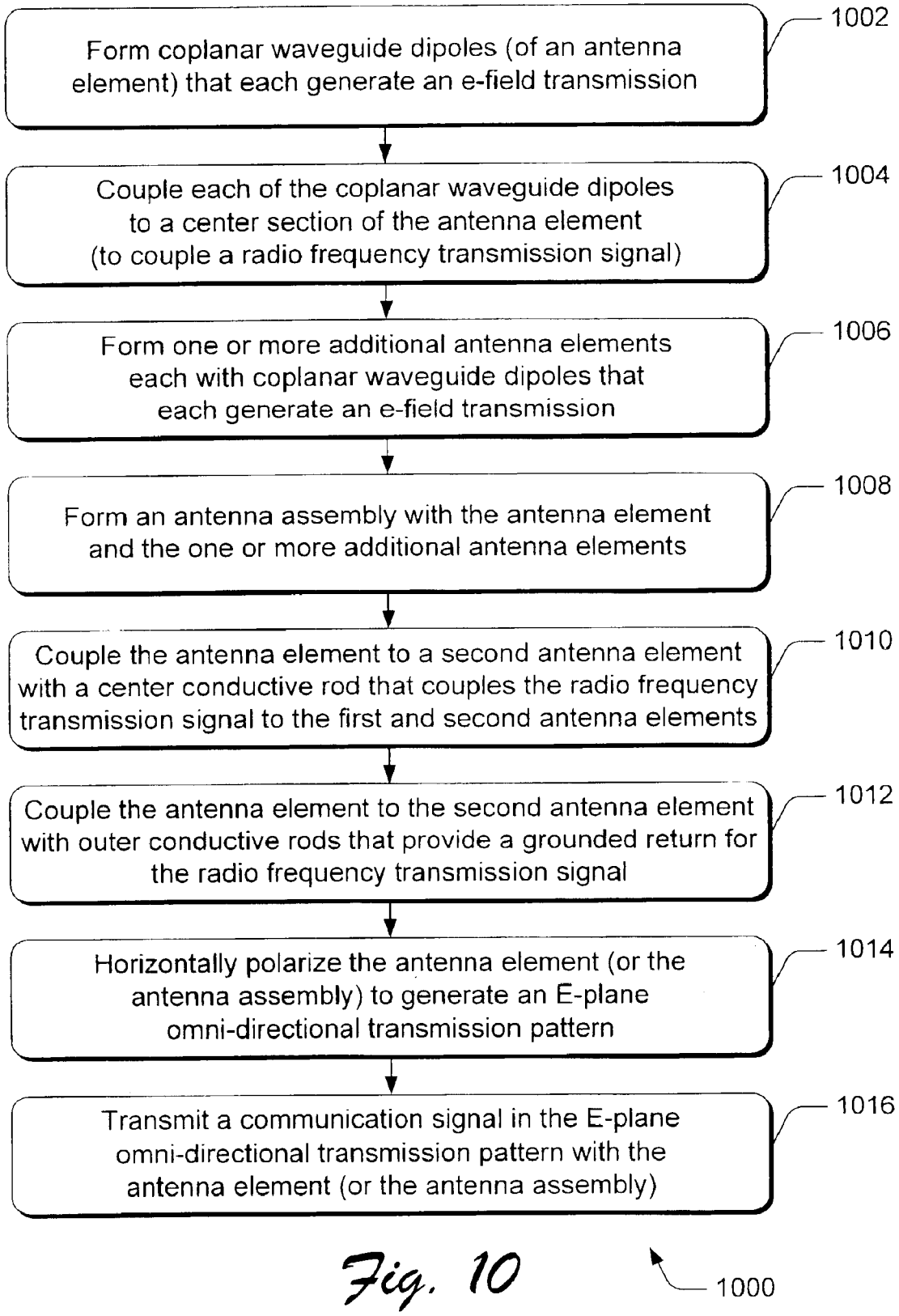
FIG. 10 is a flow diagram of an exemplary method for an E-plane omni-directional antenna.

FIG. 10 illustrates a method 1000 for an E-plane omni-directional antenna. The order in which the method is described is not intended to be construed as a limitation, and any number of the described method blocks can be combined in any order to implement the method.

At block 1002, coplanar waveguide dipoles (of an antenna element) arc formed such that each dipole is configured to generate an e-field transmission. At block 1004, each of the coplanar waveguide dipoles are coupled to a center section to form an antenna element. The center section is configured to couple a radio frequency transmission signal to each of the coplanar waveguide dipoles such that the e-field transmissions from each of the coplanar waveguide dipoles are combined to form an E-plane omni-directional transmission pattern. For example, a center section 514 (FIG. 5) of an antenna element 504(1) has a center conductor connection 506 to couple a radio frequency transmission signal to each antenna element.

Each of the coplanar waveguide dipoles can be formed with a balun to balance radio frequency currents between adjacent coplanar waveguide dipoles and/or to balance a current in a first half of a coplanar waveguide dipole with an opposing current in a second half of the coplanar waveguide dipole. For example, antenna clement 100 (FIG. 1) includes coplanar waveguide dipoles, such as coplanar waveguide dipole 102, which have a balun to balance radio frequency currents between adjacent coplanar waveguide dipole halves, such as slotted coplanar sector 104(1) and slotted coplanar sector 104(2). A balun of the coplanar waveguide dipole 102 is formed by the shorted coplanar waveguide channel 118 and the coplanar waveguide channel 122.

The coplanar waveguide dipoles are each formed with a first slotted coplanar sector (e.g., a first half of a coplanar waveguide dipole) positioned adjacent a second slotted coplanar sector (e.g., a second half of a coplanar waveguide dipole) such that a coplanar waveguide channel is formed between the first slotted coplanar sector and the second slotted coplanar sector. For example, a first slotted coplanar sector 104(1) is positioned adjacent a second slotted coplanar sector 104(2) to form the coplanar waveguide dipole 102, and to form the coplanar waveguide channel 122 between the slotted coplanar sectors 104(1) and 104(2). The coplanar waveguide channel 122 can be implemented to have an impedance that matches an impedance of a transmission signal conductor coupled to the antenna element 100. Additionally, the slotted coplanar sector 104(2) includes a shorted coplanar waveguide channel 118 and a conductor 114 (with respect to the coplanar waveguide dipole 102).

At block 1006, one or more additional antenna elements are formed. Each additional antenna element can also be formed with coplanar waveguide dipoles that each generate an e-field transmission. The coplanar waveguide dipoles are coupled to a center section of an additional antenna element and the center section couples a radio frequency transmission signal to each of the coplanar waveguide dipoles. The e-field transmissions from each of the coplanar waveguide dipoles are combined to form an E-plane omni-directional transmission pattern. For example, an antenna element 100 (FIG. 1) includes five slotted coplanar sectors 104 that are coupled to a center section 514 (FIG. 5) of the antenna element 100 to form five coplanar waveguide dipoles, such as coplanar waveguide dipole 102 (FIG. 1). The e-field transmissions 302 (FIG. 3) from each of the coplanar waveguide dipoles (e.g., dipole 102) are combined to form the E-plane omni-directional transmission pattern 300.

At block 1008, an antenna assembly is formed with antenna elements, such as with the first antenna element (blocks 1002–1004) and with one or more of the additional antenna elements (block 1006). For example, at block 1010, the antenna element is coupled to a second antenna element with a center conductive rod configured to couple a radio frequency transmission signal to the first antenna element and to the second antenna element. For example, antenna element 504(1) (FIG. 5) is coupled to the second antenna element 504(2) with the center conductive rod 510 of the transmission signal connection system 502.

Further, at block 1012, outer conductive rods are coupled to the antenna element and to the second antenna element. The outer conductive rods shield the center conductive rod, similar to that of a coaxial cable. For example, antenna element 504(1) (FIG. 5) is coupled to the second antenna element 504(2) with the outer conductive rods 512. The outer conductive rods 512 provide a grounded return for the radio frequency transmission signal and form a transverse electromagnetic propagated wave 700 between the center conductive rod 510 and an outer conductive rod 512 as shown in FIG. 7.

At block 1014, the antenna element (or the antenna assembly) is horizontally polarized to generate the E-plane omni-directional transmission pattern. At block 1016, the antenna element (or the antenna assembly) transmits a communication signal in the E-plane omni-directional transmission pattern.

Although the invention has been described in language specific to structural features and/or methods, it is to be understood that the invention defined in the appended claims is not necessarily limited to the specific features or methods described. Rather, the specific features and methods are disclosed as preferred forms of implementing the claimed invention.

What is claimed is:

1. An antenna element, comprising:

a first coplanar waveguide dipole configured to generate an e-field transmission, the first coplanar waveguide dipole including a shorted coplanar waveguide channel and a coplanar waveguide channel separated by a conductor, and at least a second coplanar waveguide dipole positioned adjacent the first coplanar waveguide dipole and configured to further generate the e-field transmission, the at least second coplanar waveguide dipole including a second shorted coplanar waveguide channel and a second coplanar waveguide channel separated by a second conductor.

2. An antenna element as recited in claim 1, further comprising additional coplanar waveguide dipoles, wherein each of the first coplanar waveguide dipole, the at least second coplanar waveguide dipole, and the additional coplanar waveguide dipoles is positioned coplanar to an adjacent coplanar waveguide dipole and is configured to generate an E-plane omni-directional transmission pattern.

3. An antenna element as recited in claim 1, wherein the first coplanar waveguide dipole and the at least second coplanar waveguide dipole each include a balun configured to balance radio frequency currents between the adjacent coplanar waveguide dipoles.

4. An antenna element as recited in claim 1, wherein the first coplanar waveguide dipole includes a balun configured to balance a current in a first half of the coplanar waveguide dipole with an opposing current in a second half of the coplanar waveguide dipole.

5. An antenna element as recited in claim 1, wherein the coplanar waveguide channel of the first coplanar waveguide dipole and the coplanar waveguide channel of the at least second coplanar waveguide dipole each has an impedance configured to match an impedance of a transmission signal conductor coupled to the antenna element.

6. An antenna element as recited in claim 1, further comprising additional coplanar waveguide dipoles, wherein each of the first coplanar waveguide dipole, the at least second coplanar waveguide dipole, and the additional coplanar waveguide dipoles are positioned coplanar to an adjacent coplanar waveguide dipole and includes a balun configured to balance opposing currents between the adjacent coplanar waveguide dipoles.

7. An antenna element as recited in claim 1, further comprising a center section configured to couple the first coplanar waveguide dipole and the at least second coplanar waveguide dipole to a radio frequency transmission signal.

8. An antenna element as recited in claim 1, further comprising a center section configured to couple the first coplanar waveguide dipole and the at least second coplanar waveguide dipole to a radio frequency transmission signal such that each of the first coplanar waveguide dipole and the at least second coplanar waveguide dipole generates the e-field transmission.

9. An antenna element as recited in claim 1, wherein the first coplanar waveguide dipole includes a first slotted coplanar sector positioned adjacent a second slotted coplanar sector.

10. An antenna element as recited in claim 1, wherein the first coplanar waveguide dipole includes a first slotted coplanar sector positioned adjacent a second slotted coplanar sector, and wherein the second coplanar waveguide dipole includes the second coplanar sector positioned adjacent a third slotted coplanar sector.

11. An antenna element as recited in claim 1, wherein:

the first coplanar waveguide dipole includes a first slotted coplanar sector positioned adjacent a second slotted coplanar sector to form the coplanar waveguide channel between the first slotted coplanar sector and the second slotted coplanar sector; and the first slotted coplanar sector includes the shorted coplanar waveguide channel and the conductor.

12. An antenna assembly comprising one or more antenna elements as recited in claim 1.

13. An antenna clement, comprising:

five coplanar waveguide dipoles each positioned adjacent two of the five coplanar waveguide dipoles, each coplanar waveguide dipole configured to generate an e-field transmission; and a center section configured to couple the five coplanar waveguide dipoles to a radio frequency transmission signal such that the e-field transmissions from each of the five coplanar waveguide dipoles are combined to form an E-plane omni-directional transmission pattern.

14. An antenna element as recited in claim 13, wherein the five coplanar waveguide dipoles each include a balun configured to balance radio frequency currents between the adjacent coplanar waveguide dipoles.

15. An antenna element as recited in claim 13, wherein the five coplanar waveguide dipoles each include a balun configured to balance a current in a first coplanar waveguide dipole with an opposing current in an adjacent second coplanar waveguide dipole.

16. An antenna element as recited in claim 13, wherein the five coplanar waveguide dipoles each include a balun configured to balance a current in a first half of a coplanar waveguide dipole with an opposing current in a second half of the coplanar waveguide dipole.

17. An antenna element as recited in claim 13, wherein each of the five coplanar waveguide dipoles include a coplanar waveguide channel that has an impedance configured to match an impedance of a transmission signal conductor coupled to the antenna element.

18. An antenna element as recited in claim 13, wherein each of the five coplanar waveguide dipoles include a first slotted coplanar sector positioned adjacent a second slotted coplanar sector.

19. An antenna element as recited in claim 13, wherein:

each of the five coplanar waveguide dipoles include a first slotted coplanar sector positioned adjacent a second slotted coplanar sector to form a coplanar waveguide channel between the first slotted coplanar sector and the second slotted coplanar sector; and the first slotted coplanar sector includes a shorted coplanar waveguide channel and a conductor, the shorted coplanar waveguide channel and the coplanar waveguide channel separated by the conductor.

20. An antenna element as recited in claim 13, wherein:

a first coplanar waveguide dipole includes a first slotted coplanar sector positioned adjacent a second slotted coplanar sector;

a second coplanar waveguide dipole includes the second slotted coplanar sector positioned adjacent a third slotted coplanar sector;

a third coplanar waveguide dipole includes the third slotted coplanar sector positioned adjacent a fourth slotted coplanar sector;

a fourth coplanar waveguide dipole includes the fourth slotted coplanar sector positioned adjacent a fifth slotted coplanar sector; and a fifth coplanar waveguide dipole includes the fifth slotted coplanar sector positioned adjacent the first slotted coplanar sector.

21. An antenna assembly comprising one or more antenna elements as recited in claim 13.

22. An antenna element, comprising:

a first slotted coplanar sector;

at least a second slotted coplanar sector positioned adjacent the first slotted coplanar sector such that a coplanar waveguide channel is formed between the first slotted coplanar sector and the second slotted coplanar sector; and a coplanar waveguide dipole configured to generate an e-field transmission, the coplanar waveguide dipole including the first slotted coplanar sector and the at least second slotted coplanar sector.

23. An antenna element as recited in claim 22, further comprising additional slotted coplanar sectors, wherein each of the first slotted coplanar sector, the at least second slotted coplanar sector, and the additional slotted coplanar sectors is positioned coplanar to an adjacent slotted coplanar sector such that a coplanar waveguide channel is formed between each adjacent slotted coplanar sector.

24. An antenna element as recited in claim 22, further comprising additional slotted coplanar sectors, wherein each of the first slotted coplanar sector, the at least second slotted coplanar sector, and the additional slotted coplanar sectors is positioned coplanar to an adjacent slotted coplanar sector such that an E-Plane omni-directional transmission pattern is generated.

25. An antenna element as recited in claim 22, wherein the coplanar waveguide channel formed between the first slotted coplanar sector and the at least second slotted coplanar sector has an impedance configured to match an impedance of a transmission signal conductor coupled to the antenna element.

26. An antenna element as recited in claim 22, further comprising a center section configured to couple the first slotted coplanar sector and the at least second slotted coplanar sector to a radio frequency transmission signal.

27. An antenna element as recited in claim 22, further comprising a center section configured to couple the first slotted coplanar sector and the at least second slotted coplanar sector to a radio frequency transmission signal such that an E-field is generated with the waveguide channel.

28. An antenna element as recited in claim 22, wherein the first slotted coplanar sector is a first half of the coplanar waveguide dipole and wherein the at least second slotted coplanar sector is a second half of the coplanar waveguide dipole.

29. An antenna element as recited in claim 22, further comprising:

a third slotted coplanar sector positioned adjacent the second slotted coplanar sector such that a second coplanar waveguide channel is formed between the second slotted coplanar sector and the third slotted coplanar sector;

a fourth slotted coplanar sector positioned adjacent the third slotted coplanar sector such that a third coplanar waveguide channel is formed between the third slotted coplanar sector and the fourth slotted coplanar sector; and a fifth slotted coplanar sector positioned adjacent the fourth slotted coplanar sector such that a fourth coplanar waveguide channel is formed between the fourth slotted coplanar sector and the fifth slotted coplanar sector, the fifth slotted coplanar sector further positioned adjacent the first slotted coplanar sector such that a fifth coplanar waveguide channel is formed between the first slotted coplanar sector and the fifth slotted coplanar sector.

30. An antenna assembly comprising one or more antenna elements as recited in claim 22.

31. An antenna system, comprising:

an antenna assembly of one or more antenna elements, each antenna element configured to transmit a communication signal over an E-plane omni-directional transmission pattern;

one or more devices configured to receive the communication signal as a wireless transmission; and the one or more antenna elements each including slotted coplanar sectors positioned to form a coplanar waveguide channel between two adjacent slotted coplanar sectors, and each including a center section configured to couple the slotted coplanar sectors to a radio frequency transmission signal such that coplanar waveguide channel e-fields are generated to form the E-plane omni-directional transmission pattern.

32. An antenna system as recited in claim 31, wherein the one or more antenna elements each include coplanar waveguide dipoles that are each configured to generate an e-field transmission.

33. An antenna system as recited in claim 31, wherein the one or more antenna elements each include coplanar waveguide dipoles that each have a balun configured to balance radio frequency currents between adjacent coplanar waveguide dipoles.

34. An antenna system as recited in claim 31, wherein the one or more antenna elements each include coplanar waveguide dipoles that each have a balun configured to balance a current in a first slotted coplanar sector with an opposing current in a second slotted coplanar sector.

35. An antenna system as recited in claim 31, wherein the one or more antenna elements each include coplanar waveguide dipoles that each have a coplanar waveguide channel formed between two adjacent slotted coplanar sectors, and wherein each of the coplanar waveguide channels has an impedance configured to match an impedance of a transmission signal conductor coupled to the one or more antenna elements.

36. An antenna system as recited in claim 31, wherein:

a first antenna element is coupled to a second antenna element with a center conductive rod that is configured to couple the first antenna element and the second antenna element to a radio frequency transmission signal; and the first antenna element is further coupled to the second antenna element with one or more outer conductive rods each configured to provide a grounded return for the radio frequency transmission signal, and further configured to shield the center conductive rod.

37. An antenna system as recited in claim 31, wherein:

a first antenna element is coupled to a second antenna element with a center conductive rod that is configured to couple the first antenna element and the second antenna element to a radio frequency transmission signal; and the first antenna element is further coupled to the second antenna element with one or more outer conductive rods each configured to provide a grounded return for the radio frequency transmission signal, and further configured to form a transverse electromagnetic propagated wave between the center conductive rod and an outer conductive rod.

38. A wireless communication system comprising one or more antenna systems as recited in claim 31.

* * * * *